United States Patent [19]

Tan et al.

[11] 4,321,012

[45] Mar. 23, 1982

[54] TURBINE BLADE FASTENING CONSTRUCTION

[75] Inventors: Toshimi Tan; Katsukuni Hisano, both of Hitachi, Japan

[73] Assignee: Hitachi, Ltd., Tokyo, Japan

[21] Appl. No.: 102,365

[22] Filed: Dec. 11, 1979

[30] Foreign Application Priority Data

Dec. 20, 1978 [JP] Japan ..... 53-156429

[51] Int. Cl.[3] ..... F01D 5/32

[52] U.S. Cl. ..... 416/217

[58] Field of Search ..... 416/215, 217

[56] References Cited

U.S. PATENT DOCUMENTS

| | | | |
|---|---|---|---|
| 2,790,620 | 4/1957 | Rankin | 416/217 |
| 2,999,668 | 9/1961 | Howard | 416/97 |
| 3,887,987 | 6/1975 | Salt | 416/215 |

FOREIGN PATENT DOCUMENTS

| | | | |
|---|---|---|---|
| 482144 | 11/1946 | Canada | 416/215 |
| 52-6806 | 1/1977 | Japan | 416/217 |
| 355759 | 2/1930 | United Kingdom | 416/217 |

*Primary Examiner*—William L. Freeh

*Attorney, Agent, or Firm*—Craig and Antonelli

[57] ABSTRACT

A moving blade fastening construction comprising moving blade fingers formed in the moving blade root portion and rotor wheel fingers formed in the rotor wheel root portion and arranged so that the fingers of the moving blade are inserted in spaces defined between the fingers of the rotor wheel, thereby to provide at least two engaging portions radially spaced from each other. An average thickness of the moving blade finger is larger than that of the rotor wheel finger which is made of material larger in Young's modulus than the moving blade fingers, whereby stresses induced in the moving blade root portion are made uniform.

4 Claims, 5 Drawing Figures

TURBINE BLADE FASTENING CONSTRUCTION

BACKGROUND OF THE INVENTION

This invention relates to a construction for fastening moving blades to a rotor wheel of a turbine, more particularly to a construction for fastening Titanium alloy moving blades to a rotor wheel made of different material in Young's modulus from the moving blades.

Moving blades of a steam turbine are fastened to a rotor wheel, with dovetails of the moving blades being inserted into recesses provided on the rotor wheel. Recently, the steam turbine is being made larger in capacity, which accompanys more elongated moving blades in the last stage. In a conventional steam turbine, as a material for moving blades, 12% Cr-alloy is used. Where moving blades made of such an alloy are made longer for example more than 40 inches (1016 mm), and used at a rotational speed of 3600 r.p.m., there is a danger such that the moving blades are broken by a centrifugal force. Therefore, for such long moving blades, it is preferable to use a material as strong as the 12% Cr-alloy and small in specific gravity. As such a material, a Titanium alloy is known. Young's modulus of the titanium alloy is very small as compared with that of an alloy used for a turbine rotor. Therefore, when the moving blades of the Titanium alloy are fastened to the turbine rotor made of an alloy which is different from the Titanium alloy with a conventional fastening construction, as shown in FIGS. 1 and 2 of Japanese Laying-open of Patent Application No. 50-139205 (1975), the dimension of which are determined by taking into consideration only strength of both the rotor material and the moving blade material, serious problems may take place. Namely, in the fastening construction of the moving blade and the rotor, deformation of the moving blade due to various force applied on the moving blade differs from that of the rotor, therefore, ununiform stresses are induced in the moving blade and the rotor, and concentrated stresses are induced in a portion of the moving blade or the rotor wheel. Such a fastening construction has danger such as cracks may take place in a portion larger in stress, that is, a portion at which the concentrated stresses are induced.

SUMMARY OF THE INVENTION

An object of the invention is to provide a mechanically strong fastening construction between moving blades and a rotor wheel made of a material which is different in Young's modulus from a material of the moving blades.

Another object of the invention is to provide a mechanically strong moving blade fastening construction between moving blades made of an alloy including Titanium and a rotor wheel made of a material different of the moving blade material, in which stresses induced in the moving blade by centrifugal force applied thereon are not concentrated in a portion of the moving blade.

Further another object of the invention is to provide a mechanically strong moving blade fastening construction between moving blades mades of a Titanium alloy and a rotor wheel made of a material different from the material of the moving blades in which uniform stresses are induced in the moving blades.

Briefly stated, a feature of the invention is that thickness of fastening portions of a moving blade or a rotor wheel which are small in Young's modulus is made larger than that of the fastening portions of the rotor wheel or moving blade which are large in Young's modulus. The fastening portions of the moving blade are engaged with the fastening portions of the rotor wheels at least two portions radially spaced from one another. Stresses induced in the two portions of the moving blade fastening construction become generally uniform, that is, the stresses are not concentrated on one of the above-mentioned two portions.

For example, thickness of fastening portions of a moving blade made of Titanium alloy is larger than that of fastening portions of a rotor wheel made of a material larger in Young's modulus than the moving blade.

DESCRIPTION OF THE PREFERRED EMBODIMENTS

Figure 1:
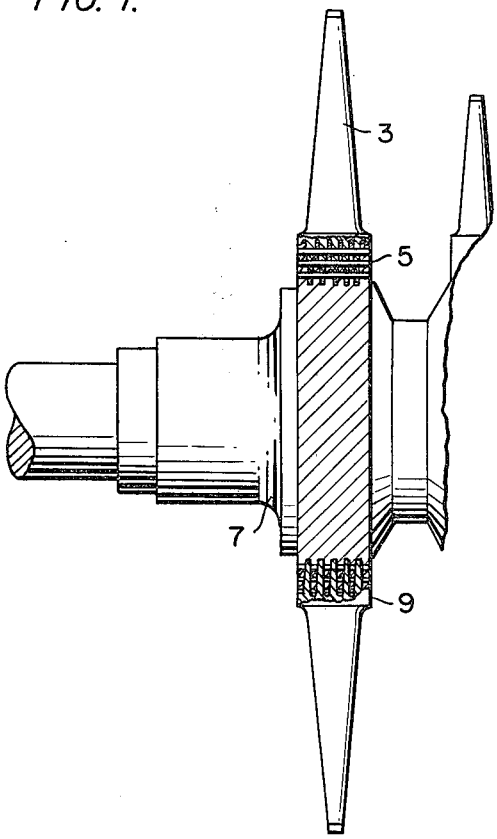
FIG. 1 is a sectional view of a part of a turbine rotor.
Figure 2:
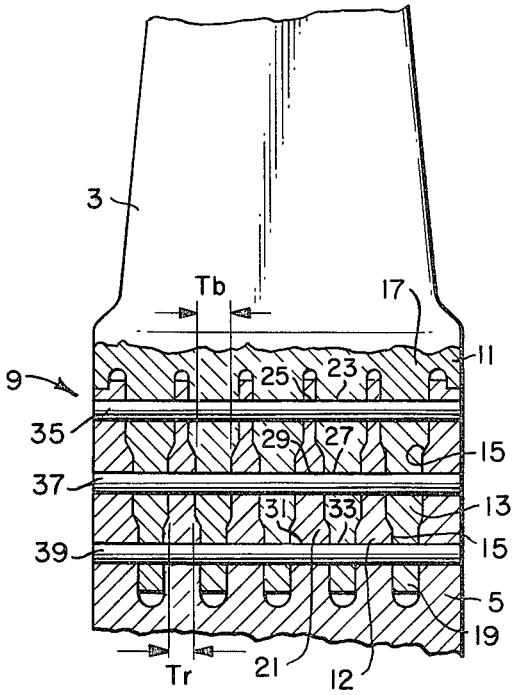
FIG. 2 is a sectional view of an embodiment of a turbine blade fastening construction according to the present invention.
Figure 3:
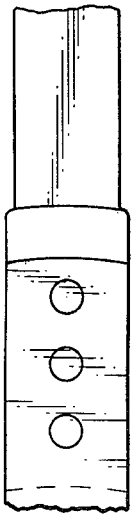
FIG. 3 is a side view of FIG. 2.

Referring to FIGS. 1, 2 and 3, an embodiment of the invention will be described hereinafter in detail.

In FIG. 1, a low pressure last stage moving blades 3 are illustrated which are arranged annularly and fastened to a rotor wheel 5 of a turbine rotor 7. The fastening construction 9 between the moving blade 3 and the rotor wheel 5 is illustrated best in FIG. 2.

In FIG. 2, the moving blades 3 are fork-shaped at their dovetails or root portions 11 and have a plurality of projections or fingers 13 formed. Each of the fingers 13 are extended radially and partially circumferentially as shown in FIG. 3. The fingers 13 each have thickness taken axially of the turbine rotor 7 and defined by their side faces 15. The thickness decreases gradually and stepwise from the root 17 to the tip 19. Between the fingers 13, spaces 12 are formed for receiving fingers 21 of the rotor wheel 5.

The rotor wheel 5 also has a plurality of fingers 21 formed on the periphery of the rotor wheel 5. The shapes of the fingers 21 of the rotor wheel 5 are similar to the fingers 13 of the moving blades 3 excepting their thickness. Between the fingers 21 of the rotor wheel 5, spaces are formed for receiving the fingers 13 of the moving blades 3.

Both the fingers 13 and the fingers 21 have a plurality of holes 23, 25 in axial alignment with each other when the fingers 13 of the moving blades 3 are inserted between the fingers 21 of the rotor wheel 5. Each of the fingers 13 and 21 have holes 27, 29 radially equally spaced from the holes 23, 25 and axially aligned with each other, holes 31, 33 which are radially equally spaced from the fholes 27, 29 and axially aligned with each other.

In these holes 23, 25, 27, 29, 31 and 33 of the fingers 13 and 21, pins 35, 37, 39 are rigidly inserted so that the moving blades 13 and the rotor wheel 5 are fastened. The moving blade 3 is fastened to the rotor wheel 5 by the pins 35, 37, 39. Therefore, the moving blade 3 engages with the rotor wheel 5 through the pins 35, 37, 39, and centrifugal force applied on the moving blade 3 is supported by the rotor wheel 5 at the pins 35, 37, 39. It is preferable that the moving blade 3 is supported evenly by the rotor wheel 5 at the pins 35, 37, 39, even if there is a difference in Young's modulus between the moving blade 3 and the rotor wheel 5.

When stress is caused on the moving blade 3 or the rotor wheel 5 be centrifugal force applied on the moving blade 3, the following equation according to Fook's law is given:

$$P/A=\epsilon\times E \quad (1)$$

wherein

P is centrifugal force (kg),

A, sectional area ($mm^2$), $\epsilon$, strain, and

E, Young's modulus ($kg/mm^2$).

Let $A_b$ express a total sectional area of the fingers 13 of the moving blade 3 taken along a direction perpendicular to a radial direction and at an average thickness of the fingers 13, and $E_b$, Young's modulus of the moving blade 3; let $A_r$ express a total sectional area of the fingers 21 of the turbine wheel 5 taken along a direction perpendicular to a radial direction and at an average thickness of the fingers 21, and $E_r$, Young's modulus of the rotor wheel 5. When the moving blade 3 and the rotor wheel 5 have substantially the same strain caused therein, that is, when stresses induced in both the moving blade 3 and the rotor wheel 5 are not concentrated on a particular portion thereof, and the following equations are given according to the equation (1)

$$P/A=\epsilon\times E_b \quad (2)$$

$$P/A_r=\epsilon\times E_r \quad (3)$$

From the equations (2) and (3), the following relation is established;

$$A_b/A_r=E_r/E_b \quad (4)$$

From the equation (4), it is noted that in order to avoid stress concentration in the fastening portion, in case where Young's modulus $E_b$ of the moving blade 3 is nearly equal to Young's modulus $E_r$ of the rotor wheel 5, the sectional area $A_b$ of the moving blade 3 is nearly equal to the sectional area $A_r$ of the rotor wheel 5, and in case where the Young's modulus $E_b$ is less than the Young's modulus $E_r$, the sectional $A_b$ of the moving blade 3 should be more than the sectional area $A_r$ of the rotor wheel 5.

The stepwise extending fingers 13, 21 of both the moving blade 3 and the rotor wheel 5 each have average thickness $T_b$ and $T_r$ between the supporting portions, respectively. The average thickness $T_b$, $T_r$ is a value obtained by dividing the sum of thickness of the root and thickness of the tip, or thickness at a central portion (27 or 29) between at two supporting portions (23 or 25, 31 or 33). Since the circumferential lengthes of the fingers 13, 21 are substantially equal, the above equation (4) is expressed as follows:

$$A_r/A_b=T_r/T_b=E_b/E_r \quad (5).$$

In this embodiment, the moving blade 3 is made of 5 Al-2.5Sn-Ti-alloy (simply called Ti alloy hereinafter), which has more than 81 $kg/mm^2$ of tensile strength and $1.2\times10^4$ $kg/mm^2$ of Young's modulus at a room temperature. The rotor wheel 5 is made of 3.5 Ni-1.75 Cr-Mo-V steel which has more than 84 $kg/mm^2$ of tensile strength and $2.1\times10^4$ $kg/mm^2$ of Young's modulus. The pins 35, 37, 39 each are made of 5Cr-1.3Mo-V steel and having tensile strength of 176 $kg/mm^2\sim197$ $kg/mm^2$. Therefore, in order to make stresses induced in the moving blade 3 and the rotor wheel 5 uniform, according to the equation 5, it is preferable that the following relation is met $$T_b/T_r=\frac{2.1\times10^4}{1.2\times10^4}=1.75=1.7\sim1.8$$

Namely, in case where the thickness $T_b$ of the finger 13 of the moving blade 3 is about $1.7\sim1.8$ times the thickness $T_r$ of the finger 21 of the rotor wheel 5, stresses induced in both the fingers 13 and 21 by centrifugal force due to rotation of the moving blade 3 are not concentrated on a particular portion of the finger 13 or 21. In one example of a fastening construction between the moving blade 3 and the rotor wheel 5, the finger 21 has length about 150 mm and thickness of 18 mm, 12 mm, 6 mm at root, middle and tip portions, respectively. Stresses induced in such a fastening construction subjecting to force corresponding to the centrifugal force are about 26 $kg/mm^2$, 25, and 24, respectively. In this embodiment, on a particular supporting portion stresses are not concentrated, distribution of the stress is made uniform on the supporting portions.

In this embodiment, the fingers 13 and 21 of the moving blade 3 and the rotor wheel 5 each have the same shape as that of a conventional finger of a moving blade or a rotor wheel except for the relation in thickness between the moving blade finger 13 and the rotor wheel finger 21.

Figure 4:
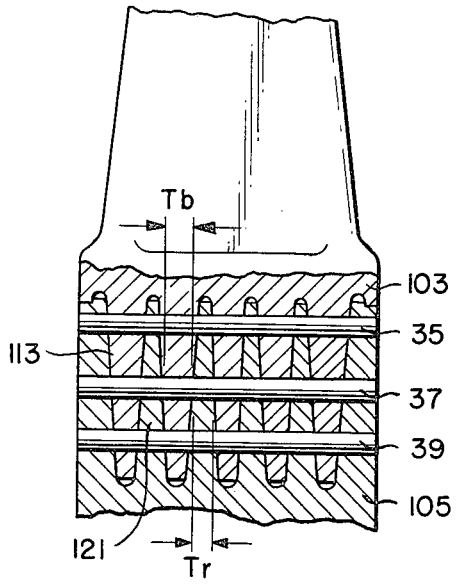
FIG. 4 is a sectional view of a modification the turbine blade fastening construction shown in FIGS. 1 to 3.

In FIG. 4, a modification of the embodiment of the invention shown in FIGS. 1 to 3 is illustrated. This fastening construction between a moving blade 103 and a rotor wheel 105 is the same as one shown in FIGS. 1 to 3, excepting that fingers 113 and 121 of the moving blade 103 and the rotor wheel 105 have straight tapered side faces for the stepwise extending side faces. Average thickness $T_b$, $T_r$ of the fingers 113 and 121 each are thickness obtained by dividing the sum of root portion thickness and tip portion thickness of the finger 113 or 121. The thickness of the finger 113 of the moving blade 3 is determined so as to satisfy the equation (5), so that strains of the fingers 113 and 121 between pins 35, 37 and 39 will be the same as one another. Therefore, stresses induced in the fingers 113 and 121 are made uniform at each of the pins 35, 37, 39. This fastening construction have an advantage that the moving blade 103 and the rotor wheel 105 is easily machined compared with the fastening construction shown in FIGS. 1 to 3 because the fingers 113 and 121 each have straight tapered side faces.

Further, another embodiment of the invention will be described hereinafter, referring to FIG. 5.

Figure 5:
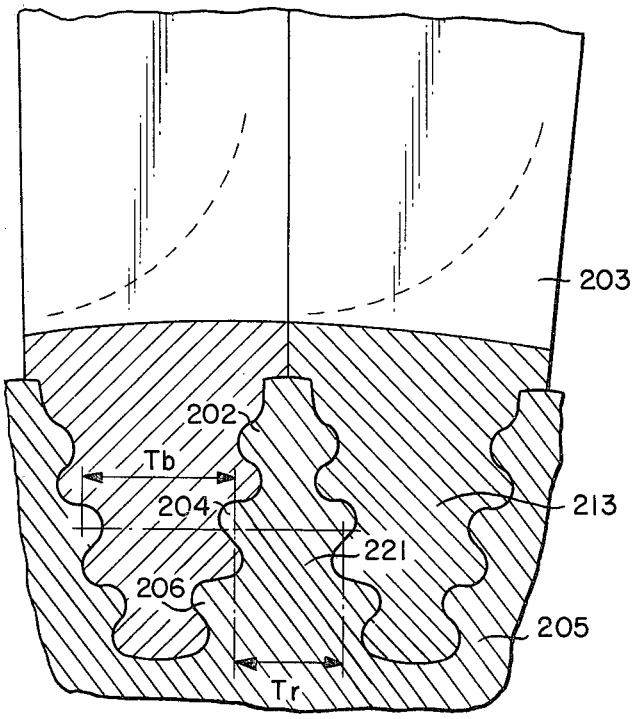
FIG. 5 is a sectional view of another embodiment of a turbine blade fastening construction according to the invention.

In FIG. 5, a moving blade 203 has a X-mas tree type fingers 213 and a rotor wheel 205 also has the same shaped fingers 221 which receive the fingers 21. When the moving blade 203 is rotated, centrifugal force due to the rotation of the moving blade 203 is supported by three swelling portions 202, 204, 206, therefore, the swelling portions 202, 204, 206 are supporting portions. In order to make strains between the swelling portions 202, 204, 206 constant between the moving blade 203 and the rotor wheel 205, that is, in order to make stresses induced in the moving blade 203 or the rotor wheel 205 uniform at the supporting portions of the moving blade 203 or the rotor wheel 205, the thickness of the moving blade fingers 213 is determined according to the equation 5, using average thickness $T_b$ of the fingers 213 and 221 obtained by dividing the sum of the swelling portion thickness by number of the swelling portions. The shapes of the fingers 213 and 221 are substantially the same as that of a conventional moving blade finger or a conventional rotor finger of X-mas tree type.

This embodiment has an advantage that the moving blade 203 can be made longer than the moving blade 3 or 103 because width of the moving blade 203 can be extended axially at its root portion.

In case where the moving blades 3, 103, 203 have difference of Young's modulus more than 20%, compared with the rotor wheel 5, 105, 205, it is preferable to apply the invention.

The fastening construction between the moving blade and the rotor wheel according to the invention is mechanically strong because stresses induced at various supporting portions of the moving blade can be made uniform if the moving blade differs in Young's modulus from the rotor wheel fastening the moving blade.

What is claimed is:

1. A construction for fastening a moving blade to a rotor wheel of a turbine comprising:

a plurality of rotor wheel projections axially and outward from the periphery of said rotor wheel, said plurality of rotor wheel projections defining spaces between adjacent projections and having thickness between said spaces;

at least a moving blade projection provided in the root portion of said moving blade, having a shape similar to said space and thickness, and inserted in one of said spaces, at least two supporting portions provided on each of said rotor wheel projections and moving blade projection, and axially spaced from each other for fastening said moving blade to said rotor wheel, the projections of one of said blade and rotor being larger in Young's modulus and being thinner in thickness than the projections of the other of said blade and rotor, wherein said moving blade projection has average thickness obtained by multiplying the average thickness of said rotor wheel projections by a ratio of Young's modulus of said rotor wheel to Young's modulus of said moving blade.

2. The construction defined in claim 1, wherein, said moving blade is made of alloy including Titanium and having Young's modulus smaller than said rotor wheel, and said moving blade projection has larger average thickness obtained by dividing two thickness measured at said supporting projections spaced most than these of said rotor wheel projections.

3. A construction for fastening moving blades to a rotor wheel of a turbine comprising a plurality of moving blade fingers formed in the root portions of said moving blades, said fingers each axially extending with spaces therebetween; a plurality of rotor wheel fingers of each rotor wheel each radially extending outward and inserted in said spaced defined by said moving blade fingers, and having spaces defined by said rotor wheel fingers and receiving said moving blade fingers; and a plurality of fastening pins radially spaced from each other and axially passing through said all fingers so that said moving blades are fastened to said rotor wheel by said fastening pins at least two portions radially spaced from each other, the improvement comprising said moving blade fingers each being made of a titanium including alloy with a smaller Young's modulus than that of said rotor wheel, and having average thickness that is greater than the average thickness of said rotor wheel fingers, which average thickness is measured axially at a central portion between a radially most separated two of said fastening pins, wherein said moving blade fingers each have an average thickness obtained by multiplying an average thickness of said rotor wheel fingers by a ratio of Young's modulus of said rotor wheel to Young's modulus of said moving blades.

4. The construction as defined in claim 3, wherein said moving blade fingers and said rotor wheel fingers each decrease in thickness toward their tip.

* * * * *